United States Patent [19]

Ellis

[11] 4,034,417

[45] July 12, 1977

[54] PROTECTIVE GARMENTS

[75] Inventor: William G. Ellis, West Vancouver, Canada

[73] Assignee: Can-Gard Protective Wear Ltd., North Vancouver, Canada

[21] Appl. No.: 584,839

[22] Filed: June 9, 1975

[51] Int. Cl.[2] ..... A41D 31/00

[52] U.S. Cl. ..... 2/81; 2/82; 2/108; 2/227; 2/243 A

[58] Field of Search ..... 2/79, 81, 82, 84, 87, 2/96, 97, 98, 100, 108, 252, 272, 247, DIG. 6; 428/246, 252, 321, 340, 341

[56] References Cited

U.S. PATENT DOCUMENTS

| | | | |
|---|---|---|---|
| 2,715,226 | 8/1955 | Weiner | 2/87 X |
| 3,147,490 | 9/1964 | Allen et al. | 2/84 |
| 3,169,298 | 2/1965 | Tachibana | 2/97 UX |
| 3,196,459 | 7/1965 | De Grazia | 2/96 |
| 3,231,899 | 2/1966 | Seidel et al. | 2/247 X |
| 3,372,438 | 3/1968 | Rinecker | 2/252 X |
| 3,833,938 | 9/1974 | Shweid | 2/96 |
| 3,849,802 | 11/1974 | Govaars | 2/81 |

FOREIGN PATENT DOCUMENTS

| | | | |
|---|---|---|---|
| 1,194,714 | 5/1959 | France | 2/84 |

OTHER PUBLICATIONS

"Nomex: Promising Raw Material for Industrial Knits," Knitted Outerwear Times, vol. 39, No. 28, July 6, 1970.

*Primary Examiner*—Werner H. Schroeder
*Assistant Examiner*—Moshe I. Cohen
*Attorney, Agent, or Firm*—Larson, Taylor and Hinds

[57] ABSTRACT

A protective garment, jacket and/or pants, made of a fabric unit which includes an outer shell and an inner shell with a liner therebetween, these being secured together at edges thereof. The outer and inner shells are formed of light, non-moisture-absorbent fabric capable of withstanding high temperatures, and said liner is formed of relatively soft and heat resistant fabric and is thick enough to give the fabric unit a predetermined thickness and to act as a spacer to allow for air insulation and circulation.

25 Claims, 10 Drawing Figures

PROTECTIVE GARMENTS

Figure 1:
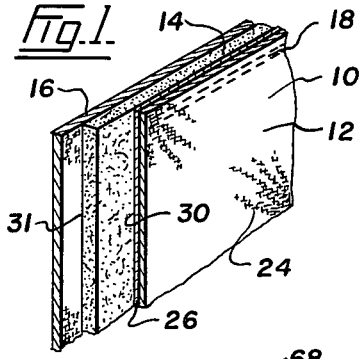

This invention relates to protective garments primarily for firemen to protect them against heat, water and chemicals, but which can be worn for other purposes. The term "garment" as used herein means a jacket or coat and/or pants. However, the invention is mainly concerned with jackets and will be described in connection with these.

There are jackets or coats in existence which are used mainly by firemen. The jacket most commonly in use is made of a heavy canvas-like material. Many of these jackets have liners removably mounted therein so that they can be taken out for cleaning purposes. The material of the prior art jackets resists heat and fire but only up to a certain point. They also repel water for a short period of time, but when exposed to much water they absorb some of it and gradually become heavier. The prior jackets are relatively heavy in the first place, and this taking on of water increases the load while a fireman continues to fight the fire. The longer he is exposed to water the greater becomes his load while he is tiring as a result of his efforts.

The present invention eliminates the problems of the garments used by firemen in the past by providing a garment that is very light in weight, will withstand very high temperatures before starting to char or deteriorate, is impervious to water and air, does not absorb any moisture, and can be cleaned by normal methods. It preferably does not have a removable lining, and it can be improved by a rollout hood permanently secured thereto which is immediately available to protect the wearer's head but is normally folded out of sight in a collar arrangement of the garment. In addition, the present garment does not have any metal components.

A garment in accordance with this invention comprises a main section for enclosing a portion of the body of a wearer, and tubular sections connected to and opening into the main section and positioned so that limbs of the wearer can extend therethrough; said main and tubular sections comprising an outer sheet of light-weight, non-moisture-absorbent fabric capable of withstanding high temperatures before starting to char, a liner of relatively soft and heat resistant fabric, and an inner shell of light-weight, fire-resistant, non-moisture-absorbent fabric, said outer shell, liner and inner shell being secured together at edges thereof to form a cloth unit, said liner besides helping to protect the wearer acting as a spacer in the cloth unit to allow for air insulation and circulation within said unit and giving the latter a predetermined thickness.

This garment can be a jacket or a coat, in which case the tubular sections receive the arms of the wearer, or it can be in the form of a pair of pants so that the tubular sections receive the legs of the wearer.

The construction and method of manufacturing the garment are important in obtaining the desirable results, but the most important factor is the cloth unit from which a garment is made. The cloth unit consists of an outer shell, a liner and an inner shell which are secured together at edges thereof. These two shells and the liner each have an important function, but they also form a combination which result in a light-weight protective garment primarily for firemen which is a vast improvement over any garment for the same purpose which is in use today. Of very great importance is the fact that the cost of this garment is roughly the same as the garments presently in use for the same purposes.

The outer shell is made of a light weight, non-moisture-absorbant fabric capable of withstanding high temperatures, for example, up to about 850° F, before starting to char. The most successful for this purpose so far is a fabric made of aromatic nylon yarn. A very desirable fiber for this purpose is on the market and sold under the trade mark NOMEX. This aromatic nylon product consists of synthetic man-made fibres which are processed and twisted to create the yarn which is woven into the fabric. The finished warp is 200 denier, and the weave is a 2 × 2 basket with about 97 × 60 or 96 × 74 pic count. The woven yarns produce a fabric weighing from 3 oz. to 6 oz. per square yard. A fabric weighing about 5.73 ozs. per square yard has been found very suitable for this purpose since it can withstand up to about 850° F of heat. The inner surface of this fabric is coated with a suitable waterproofing material, such as Neoprene or Polyurathene. This coating is applied at a rate of about 2 ozs. per square yard, and the resulting fabric will not absorb any water, and is moistureproof under a water pressure of about 200 psi. It is also desirable to heat set and scour this fabric in preparation for a following treatment with a suitable substance such as silicone, which helps to retard soil, oil, grease stains, and assists in providing a water barrier.

The liner must be light in weight, soft and very flexible. It also must have considerable thickness since it must produce with the outer and inner shells a fabric unit having a thickness sufficient to meet the standards set for fire protective garments. At the present time a total thickness of at least about 0.175 in. is required in the United States.

The preferred form of liner is made of synthetic nylon fibres such as aromatic nylon fibres with a resin finish and weighing about 6 oz. per square yard. This fabric is needle punched so as to provide for air circulation between the outer and inner shells. This circulation is assisted by the fact that the shells and the liner are secured together only at edges thereof so that they are free for limited movement relative to each other.

Another suitable liner is one made of needle punched Dacron fibres with lanolin treatment and weighing about 4 ozs. per square yard. In either case, the liner acts as an inner heat resistant barrier and gives the wearer additional protection and comfort.

The inner shell can be made of material which is the same as or similar to that of the outer shell. It has been found preferable to use a fabric of aromatic nylon yarns which is lighter in weight than the outer shell fabric, for example, 3.73 to 4.5 ozs. per square yard. It is also preferable to subject this fabric to a calendering process which tightens the weave and gives the fabric additional moisture resistance and a soft, pliable feeling for the wearer. It also should be treated with silicone so that it will act as soil, oil, grease repellent and also produces an additional water barrier.

Figure 7:
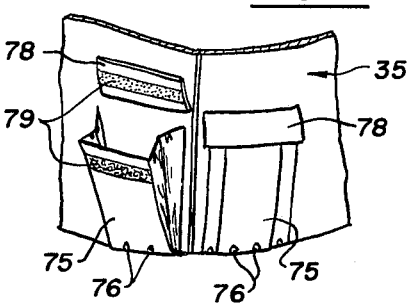
Figure 2:
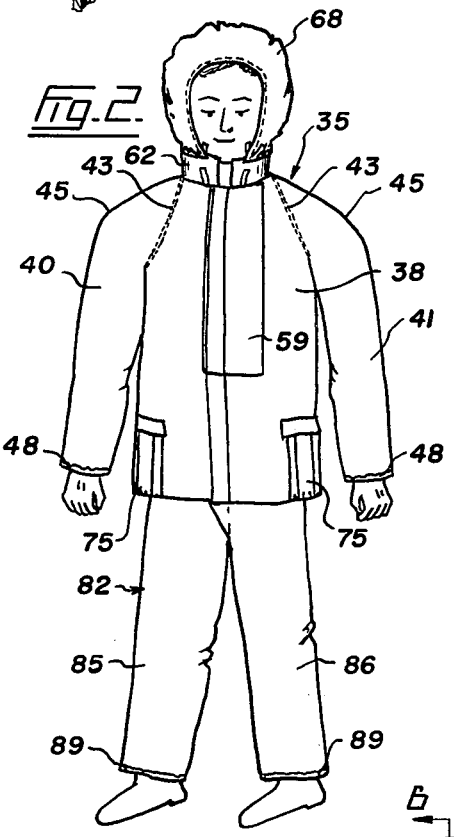
Figure 3:
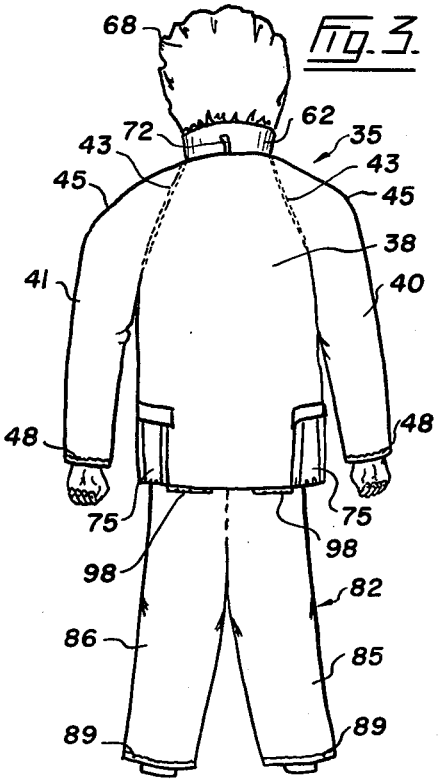
Figure 4:
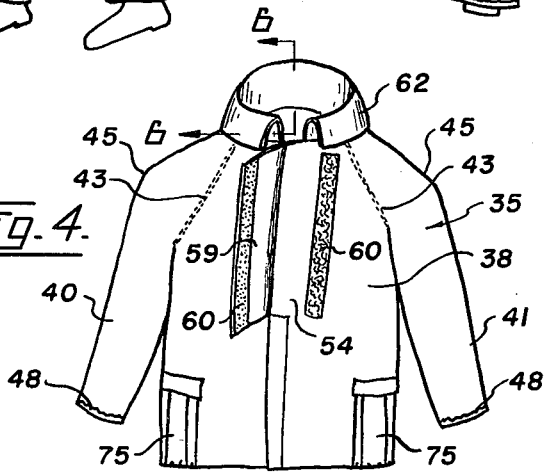
Figure 5:
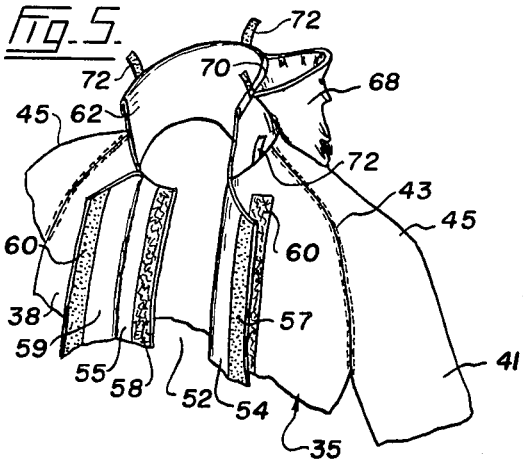
Figure 6:
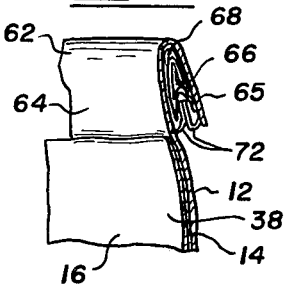
Figure 8:
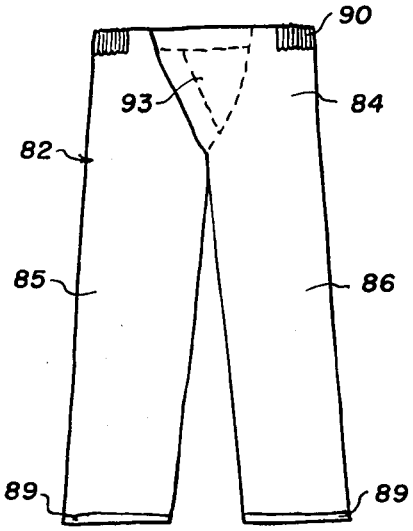
Figure 9:
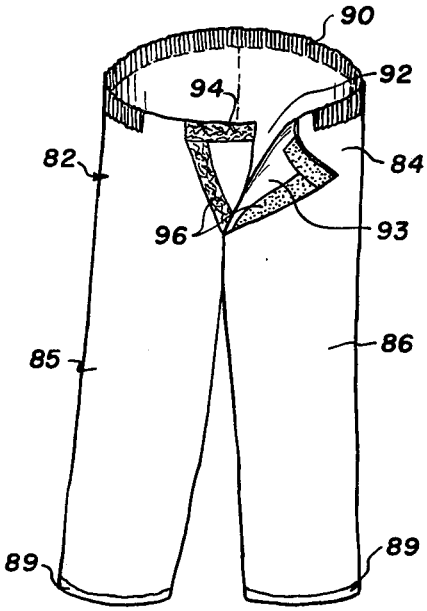
Figure 10:
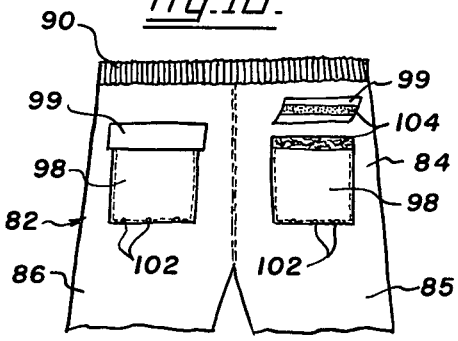

Preferred forms of this invention are illustrated in the accompanying drawings in which:

FIG. 1 is an enlarged diagrammatic view of a portion of a fabric unit in accordance with this invention, FIG. 2 is a front elevation of a man wearing a jacket or coat with the hood up and pants, in accordance with this invention, FIG. 3 is a rear view of the man with the jacket and pants, FIG. 4 is a front elevation of the jacket alone closed and with the collar in the normal fold-down position, FIG. 5 is a view of the jacket opened and with the collar up and the hood partially raised, FIG. 6 is an enlarged sectional view through the collar and taken on the line 6—6 of FIG. 4, FIG. 7 is an enlarged view of a pocket arrangement for the jacket, showing one pocket open, FIG. 8 is a front view of the pants in accordance with this invention, FIG. 9 is a elevation of the pants with the front open, and FIG. 10 is a rear view of the pants showing a pocket arrangement, showing one pocket open.

Referring to FIG. 1 of the drawings, 10 is a fabric unit made in accordance with the present invention. This fabric unit comprises an outer shell 12, a liner 14, and an inner shell 16. These are secured together at edges thereof in any suitable manner such as double stitching either visible or unseen indicated at 18.

The outer shell 12 consists of a tightly woven fabric 24 having applied to the inner surface thereof, a layer 26 of water-repellent material, such as neoprene or polyurethane. This layer is very thin and is absorbed partly into the woven fabric, but it is shown in FIG. 1 as being relatively thick in order to be seen. The thickness of the coating 26 can be visualized when it is realized that it is applied at the rate of about 2 oz. per square yard. As stated above, fabric 24 is preferably an aromatic nylon yarn tightly woven into the cloth, and it is preferably treated with silicone to render it resistant to soil, oil and grease stains.

The liner 14 is preferably formed of needle punched aromatic nylon fibers with a resin finish. These fibres are more or less in felted form, and the liner is relatively thick so as to provide the entire fabric unit 10 with the necessary thickness, which at the present time is about 0.175 in. in the United States.

As an alternative, the liner 14 can be made of needle punched Dacron fibers with the lanolin treatment and weighing about 4 ozs. per yard.

The inner shell 16 is preferably formed of fabric similar to the fabric of outer shell 12. It can be exactly the same as the outer shell, but for the sake of weight and comfort to the wearer, it is preferably made up of tightly woven aromatic nylon yarn having a weight of about 3.73 to about 4.5 ozs. per square yard. This fabric is preferably calendered to tighten the weave, to provide additional moisture resistance, and to give it a soft pliable feeling for the wearer. This fabric also is preferably treated with silicone.

As the outer and inner shells and liner 14 are secured together mainly at the edges thereof, there are spaces 30 and 31 therebetween so that air can circulate between them and to some extent at least through the needle holes of the liner. This air also acts as heat insulation. In addition, these elements can move to a limited degree relative to each other so as to make it easier for a person wearing the garment to bend. Although the three layers form a relatively thick fabric unit, the latter is quite flexible because of this relative movement of the layers.

Referring to FIGS. 2 to 7, 35 is a jacket or coat formed of the fabric unit 10. This jacket has a main section 38 which when the jacket is worn encloses the body of the wearer. Tubular sections 40 and 41 are positioned to receive the arms of the wearer. The tubular sections 40 and 41 open into the body section 38 in the usual way, and are secured thereto in any desired manner, such as by double stitching 43. In this example, the tubular sections 40 and 41 are shaped to form raglan shoulders 45 for the garment. The outer ends of the sections 40 and 41 are provided with expansible wristlets 48 which fit tightly around the wrists of the wearer. The material of these can be similar to the material of the inner shell, but loosely knit or woven. Alternatively, the wristlets can be replaced by elastic material attached to the outer ends of tubular sections 40 and 41.

Jacket 35 is open at the front, as indicated at 52 in FIG. 5, and has a wide flap 54 along one side of the opening and integrally formed with the main section 38. This flap is adapted to overlie a wide portion 55 of the main section. It is preferable to use a non-metal fastener, and in this example, it consists of the male and female elements or tapes of a fastener known as "VELCRO" secured to the flap and to the wide portion. These tapes are nonmetallic and fire and heat resistant. It is preferable to make flap 54 wide enough to place a relatively wide element or tape 57 of the fastener thereon, in which case a relatively wide corresponding element or tape 58 of the fastener is secured to the wide portion 55. Flap 54 overlaps a substantial portion of the main section 38 at the opposite side of opening 52 so as to provide the wearer good protection against water, heat and air. The corresponding wide tapes of the fastener firmly and reliably hold the flap in position, and yet the flap can be quickly and easily opened merely by grasping and pulling it away from the body of the jacket. If desired, an additional storm flap closure 59 may be attached by sewing or the like to the jacket along the inner side of the wide portion 55. This flap closure is wide enough to reach over said wide portion and flap 54. Mating elements 60 of a fastener are secured to the inner surface of flap closure 59 and the outer surfae of the jacket along the inner edge of flap 54.

The body section 38 of jacket 35 is provided with a collar 62 at the upper end thereof. This collar is preferably formed of the same material as the main section or it may be made of the outer shell fabric alone, in either case it preferably is integrally connected to the body section. This collar is wide enough to fold back on itself into overlapping inner and outer collar sections 64 and 65, respectively. These sections form a pocket 66 therebetween in which a rolled hood 68 nomally fits out of sight. This hood is preferably formed of the same material as the outer shell 12. The hood is relatively thin, light-weight and pliable. This hood is secured at an edge thereof to the collar 62 along the outer edge 70 thereof. When the hood is rolled or folded up, it lies along the outer surface of the inner collar section 64 so that the outer collar section 65 can be turned down or folded over the hood, as shown in FIG. 6. It is preferable to provide fastener tabs 72 on the opposed surfaces of the collar sections 64 and 65 so that the outer section 65 can be fastened in place when the hood is not required.

Jacket 35 is preferably provided with one or more accordian pockets 75 on its outer surface. These pockets can be made from the same material as outer shell 12, and secured to the said outer shell in any desired manner such as by stitching. Each pocket 75 preferably has a plurality of drain holes 76 at the bottom thereof, and a flap 78 positioned to be folded over and close the top of the pocket. If desired, suitable fastening means can be provided for each flap 78, such as male and female Velcro elements 79 as shown in FIG. 7.

Referring to FIGS. 8, 9 and 10, the garment of this invention may comprise a pair of pants 82 made of the fabric unit 10. In this case, the pants include a main section 84 for enclosing the lower part of the wearer's body and tubular sections 85 and 86 for receiving his legs. The outer ends of tubular sections 84 and 85 may be provided with flexible anklets 89 for gripping the ankles of the wearer. These pants may be held up in any suitable manner, such as by a heavy stretchable band 90 extending around and secured to the top thereof.

The pants 82 are formed with a fly opening 92 at the front thereof, and with a relatively wide flap 93 along one edge of the opening and a relatively wide portion 94 along the opposite edge thereof. Non-metal, co-operating fastening elements 96 are provided on the opposing surfaces of flap 93 and portion 94 so that when the flap is folded over this portion, these elements are pressed together to hold the flap closed.

Pants 82 may be provided with one or more pockets 98, each having a flap 99 adapted to overlap and close the upper end thereof. Each pocket may be formed with drain holes 102 in the bottom thereof, and the flap 99 and the pocket portion overlapped thereby are provided with non-metal, co-operating tapes 104 on their opposed surfaces so that when the flap is folded over the pocket, these tapes are pressed together to retain the flap in the closed position.

The above-described garments protect the wearer against heat, cold and water. The finished product will withstand temperatures up to about 2,000° F for about 14 seconds before starting to char. The material of the outer shell will not char when exposed to temperatures up to about 850° F for even longer periods than that. Water is repelled so that not only is the wearer protected from it, but his garments do not increase in weight no matter how long he is exposed to the water. The extra large size jacket weighs about 3.14 lbs. and the corresponding pants about 2.9 lbs. These are at least 200% lighter than any other corresponding garments now available for the same purposes when the latter are dry. However, the latter garment readily absorbs water for protection purposes and so its weight rapidly increases.

I claim:

1. A garment for protecting a wearer thereof against heat and cold, moisture, chemicals and gas, comprising a main section for enclosing a portion of the body of a wearer and tubular sections connected to and opening into the main section and positioned so that limbs of the wearer can extend therethrough; said main and tubular sections comprising an outer shell of light-weight fabric capable of withstanding high temperatures up to about 850° F for up to about 14 seconds before starting to char, said fabric being tightly woven from synthetic yarn and having a waterproof coating on its inner surface such that the coated fabric is substantially non-absorbent to water and substantially moistureproof under water pressure of up to about 200 psi, a relatively thicker liner of relatively soft and heat resistant fabric, and an inner shell of light-weight, fire-resistant, moisture-repellant fabric, said outer shell, liner and inner shell being secured together at edges thereof and being free from each other between said edges and forming a cloth unit, said liner, besides helping to protect the wearer, acting as a spacer in the cloth unit to give the latter a predetermined thickness, and the free portions of said outer shell, liner and inner shell being free to move relative to each other while the garment is being worn allow for air insulation and circulation and allow for easy flexing of the cloth unit.

2. A protective garment as claimed in claim 1 in which said garment is a jacket and said tubular sections receive the arms of the wearer.

3. A protective garment as claimed in claim 1 in which said garment is a pair of pants and said tubular sections receive the legs of the wearer.

4. A protective garment as claimed in claim 2 in which said main section is open at the front and is formed with a wide flap along one edge thereof at the opening for overlapping a wide portion of the opposite edge at the opening, and including a non-metal fastener between and having interconnectable elements secured to the flap and said wide portion overlapped thereby.

5. A protective garment as claimed in claim 4 including a flap closure secured to the main section near said wide portion and wide enough to overlap said wide portion and the wide flap, and non-metal fastener means between the flap closure and the main section near said wide flap.

6. A protective garment as claimed in claim 3 in which said main section is open at the front and is formed with a flap along one edge thereof at the opening for overlapping a portion of the opposite edge of the opening, and including a non-metal fastener between and having interconnectable elements secured to the flap and said portion overlapped thereby.

7. A protective garment as claimed in claim 2 including at least one accordian pocket formed of similar material to that of the outer shell secured to said outer shell, and at least one drain hole formed in the pocket.

8. A protective garment as claimed in claim 6 including a flap secured to the outer shell and overlapping and normally closing the pocket, and a non-metal fastener between and having interconnectable elements secured to the latter flaps and the portion of the pocket overlapped thereby.

9. A protective garment as claimed in claim 2 including a collar formed by an extension of the outer shell fabric connected to the main section, said collar being wide enough to fold back on itself into overlapping inner and outer collar sections forming a pocket therebetween, and a hood formed of fabric similar to that of the inner shell secured to the collar and foldable normally to fit within said collar pocket.

10. A protective garment as claimed in claim 9 including fastening means releasably on the inner and outer collar sections for securing said sections together with the hood in the collar pocket.

11. A protective garment as claimed in claim 1 in which said outer shell comprises a fabric of tightly-woven aromatic nylon yarns and weighing from 3 ounces to 6 ounces per square yard.

12. A protective garment as claimed in claim 1 in which said outer shell comprises a fabric of tightly-woven aromatic nylon yarns, said waterproof coating comprising neoprene or polyurethane.

13. A protective garment as claimed in claim 1 in which said outer shell comprises a fabric of tightly-woven aromatic nylon yarns, said waterproof coating comprising neoprene or polyurethane at the rate of about 2 ounces per square yard.

14. A protective garment as claimed in claim 1 in which said outer shell comprises a fabric of tightly-woven aromatic nylon yarns and treated with silicone.

15. A protective garment as claimed in claim 1 in which said outer shell comprises a fabric of tightly-woven aromatic yarns, and treated with silicone, said waterproof coating comprising neoprene or polyurethane.

16. A protective garment as claimed in claim 1 in which said liner comprises aromatic nylon fibres.

17. A protective garment as claimed in claim 1 in which said liner comprises needle-punched aromatic nylon fibres.

18. A protective garment as claimed in claim 1 in which said liner comprises needle-punched aromatic nylon fibres treated with resin.

19. A protective garment as claimed in claim 1 in which said liner comprises dacron fibres.

20. A protective garment as claimed in claim 1 in which said liner comprises needle-punched dacron fibres.

21. A protective garment as claimed in claim 1 in which said liner comprises needle-punched dacron fibres treated with lanolin.

22. A protective garment as claimed in claim 1 in which said inner shell comprises a calendered fabric of tightly-woven aromatic nylon yarns.

23. A protective garment as claimed in claim 1 in which said inner shell comprises a calendered fabric of tightly-woven aromatic nylon yarns treated with silicone.

24. A protective garment as claimed in claim 1 in which the outer shell and the inner shell each comprises a fabric of tightly-woven aromatic nylon fibres heat set and scoured, and said outer shell fabric having said waterproof coating on the surface thereof forming the inner surface of the outer shell.

25. A protective garment as claimed in claim 1 in which the outer shell and the inner shell each comprises a fabric of tightly-woven aromatic nylon fibres heat set and scoured, and said outer shell fabric having said waterproof coating on the surface thereof forming the inner surface of the outer shell and said inner shell fabric is calendered and treated with silicone.

* * * * *